US010773868B2

(12) United States Patent
Maguire et al.

(10) Patent No.: US 10,773,868 B2
(45) Date of Patent: Sep. 15, 2020

(54) CONTAINER CLOSURE HAVING MEANS FOR INTRODUCING AN ADDITIVE INTO A LIQUID IN THE CONTAINER

(71) Applicant: Gizmo Packaging Limited, Glasgow (GB)

(72) Inventors: Jordan Maguire, Glasgow (GB); Bernard Frutin, Glasgow (GB)

(73) Assignee: GIZMO PACKAGING LIMITED (GB)

( * ) Notice: Subject to any disclaimer, the term of this patent is extended or adjusted under 35 U.S.C. 154(b) by 122 days.

(21) Appl. No.: 16/301,099

(22) PCT Filed: May 17, 2017

(86) PCT No.: PCT/GB2017/051375

§ 371 (c)(1),
(2) Date: Nov. 13, 2018

(87) PCT Pub. No.: WO2017/199024

PCT Pub. Date: Nov. 23, 2017

(65) Prior Publication Data

US 2019/0185231 A1 Jun. 20, 2019

(30) Foreign Application Priority Data

May 18, 2016 (GB) ..... 1608713.2
Oct. 26, 2016 (GB) ..... 1618079.6

(51) Int. Cl.
*B65D 51/28* (2006.01)

(52) U.S. Cl.
CPC ..... *B65D 51/2864* (2013.01); *B65D 51/2892* (2013.01)

(58) Field of Classification Search
CPC ..... B65D 51/2864; B65D 51/2892; B65D 41/04; B65D 41/3447
(Continued)

(56) References Cited

U.S. PATENT DOCUMENTS 5,980,959 A * 11/1999 Frutin ..... B65D 85/73 206/222
2009/0236244 A1* 9/2009 Frutin ..... B65D 51/2892 206/219
2009/0321286 A1* 12/2009 Frutin ..... B65D 51/2892 206/219
2010/0012532 A1* 1/2010 Frutin ..... B65D 47/242 206/221
(Continued)

FOREIGN PATENT DOCUMENTS

DE 102014113391 A1 11/2015
WO WO-2007129116 A1 11/2007
WO WO-2008023197 A1 * 2/2008 ..... B65D 51/2864

OTHER PUBLICATIONS

Fournier, Jacques, "International Search Report," prepared for PCT/GB2017/051375, dated Jul. 3, 2017, three pages.

*Primary Examiner* — Shawn M Braden
(74) *Attorney, Agent, or Firm* — Edell, Shapiro & Finnan, LLC

(57) ABSTRACT

A closure device (210) for use on the neck (238) of a bottle comprises a cap member (236) having a side wall (237) adapted to be secured to the neck, a fluid chamber (260) fixed at its upper end to the cap member and having a bottom aperture (266) at its lower end, a housing (254) at least partially surrounding the fluid chamber and having a flange member (258) adapted to extend at least partially across the top of the container neck, and a plug member (264) fixed to the housing and sealingly engageable in the bottom aperture of the fluid chamber. The plug member (264) has a nozzle (274) therein, and the housing (254) is adapted to move relative to the cap member (236) between a first closed position of the closure device before securing to the neck of the bottle, in which the plug member (264) seals the bottom aperture (266) closed and the housing or cap member is engaged by a detent member (204) provided to prevent movement of the housing away from the cap member, and a second armed position in which the closure device is secured to the neck of the bottle, and in which the plug member (264) continues to seal the bottom aperture (266) closed and the flange member (258) or detent member (204)
(Continued)

is deformed to a position in which the housing can no longer be engaged by the detent member (204). An internal rib (206) on the housing may engage with the detent member to prevent movement of the housing away from the cap member in the first closed position of the closure device. The detent member (204) may be deformable such that in the second armed position of the closure device the detent member is deformed to a position in which the internal rib can no longer be engaged by the detent member, to permit the closure device to move to a third firing position when the closure device is removed from the neck.

20 Claims, 10 Drawing Sheets

(58) Field of Classification Search
USPC ..... 215/227
See application file for complete search history.

(56) References Cited

U.S. PATENT DOCUMENTS

| | | | | |
|---|---|---|---|---|
| 2012/0305519 | A1* | 12/2012 | Lee | B65D 47/12 215/316 |
| 2014/0166510 | A1* | 6/2014 | Frutin | B65D 51/2864 206/221 |
| 2018/0186528 | A1* | 7/2018 | Tonn | B65D 51/2864 |
| 2018/0305095 | A1* | 10/2018 | Presche | B65D 51/2892 |

* cited by examiner

CONTAINER CLOSURE HAVING MEANS FOR INTRODUCING AN ADDITIVE INTO A LIQUID IN THE CONTAINER

The present invention relates to a closure device, for use with a container such as a beverage container, which can fire a pressurised additive liquid into a liquid in the container by operation of the closure device. The invention also relates to a container including such a closure device and to a method of introducing an additive liquid by means of operating such a closure device.

In a number of applications, such as mixtures of different liquids, it may be necessary to release and mix an additive liquid into another liquid shortly before the liquid mixture is used. It may not be possible or desirable to store the liquids in a premixed form, as they may react undesirably with each other when stored as the mixture for a period of time. An example of this may be two component pharmaceuticals which have a longer shelf life when unmixed than they do when mixed. However, it can also apply to other liquids or to mixtures of liquids and gases, such as water, alcoholic beverages, other beverages, and other solvents or solutions. The term "beverage" when used in this specification includes any liquid, whether or not provided for drinking purposes, which may be mixed with an additive liquid, and is not limited to potable beverages.

A closure device for use with a beverage container which can release an additive liquid into the beverage by operation of the closure device is known from the prior art. International Patent Application WO2007/129116 discloses a closure device comprising a cap member defining a fluid chamber and a plug member which sealingly engages an aperture in the bottom of the fluid chamber. The cap member is raised relative to the plug member by unscrewing the cap member, from a closed position in which the plug member closes the bottom aperture to an open position in which the plug member is partially withdrawn from the bottom aperture to allow pressurised fluid to flow from the fluid chamber through a nozzle passage in the plug member to the beverage in the beverage container.

The known device has the disadvantage that it is relatively complex to manufacture, requiring separate housing and cap members, both of which extend outside the neck of the container. The closure has a larger diameter than conventional closures, since it must accommodate a housing flange between the external thread of the bottle neck and the internal thread of the outer cap wall. The closure requires the threaded connection between the cap and the housing flange to turn first, so that the cap member is raised relative to the plug member causing the additive to be fired from the pressurised fluid chamber, before the threaded connection between the housing flange and the bottle neck. If the threaded connection between the cap and the housing flange is too stiff, the threaded connection between the housing flange and the bottle neck may turn first, so that the closure device is removed from the bottle without firing.

It is an object of the present invention to overcome one or more disadvantages of the prior art.

Closure Device

According to a first aspect of the present invention there is provided a closure device for use with a container having a main liquid compartment and an opening with a container neck, the closure device comprising:

- a cap member having a side wall adapted to be secured to the opening of the container,
- a fluid chamber fixed at its upper end to the cap member and having a bottom aperture at its lower end,

- a housing at least partially surrounding the fluid chamber and having a flange member adapted to extend at least partially across the top of the container neck,
- a plug member fixed to the housing and sealingly engageable in the bottom aperture of the fluid chamber,
- wherein the plug member has a nozzle therein,
- wherein the housing is adapted to move relative to the cap member between a first closed position of the closure device, in which the plug member seals the bottom aperture closed and the housing or cap member is engaged by a detent member provided to prevent movement of the housing away from the cap member, and a second armed position, in which the plug member continues to seal the bottom aperture closed and the flange member or detent member is deformed to a position in which the housing can no longer be engaged by the detent member.

Preferably the detent member is provided on the cap member or fluid chamber, and in the first closed position of the closure device the housing is engaged by the detent member. However the detent member may be provided on the housing so that the in the first closed position of the closure device the cap member or fluid chamber is engaged by the detent member.

In the first closed position of the closure device the housing may comprise an internal rib engaged by the detent member to prevent movement of the housing away from the cap member. In the second armed position of the closure device the detent member may be deformed to a position in which the internal rib can no longer be engaged by the detent member.

If the detent member is provided on the housing, in the first closed position of the closure device the cap member or fluid chamber may comprise an external rib engaged by the detent member to prevent movement of the housing away from the cap member. In the second armed position of the closure device the detent member may be deformed to a position in which the external rib can no longer be engaged by the detent member.

The side wall of the cap member may be threaded and may be adapted to engage with a thread or projection provided on the container neck.

The cap member may be a crown cap and may be adapted to engage with a flange provided on the container neck.

The cap member may be a threaded crown cap and may be adapted to engage with a thread provided on the container neck.

Collapsible Flange and Bridge Embodiments

In the first closed position of the closure device the flange member of the housing may be engaged by the detent member to prevent movement of the housing away from the cap member. In the second armed position of the closure device the flange member may be deformed to a position in which the flange member can no longer be engaged by the detent member.

Collapsible Flange Embodiment

In one preferred embodiment the flange member is adapted to extend across the top of the container neck and engage with a detent member provided on an inner surface of the threaded side wall of the cap member. In this embodiment the housing is adapted to move relative to the cap member between a first closed position of the closure device, in which the plug member seals the bottom aperture closed and the flange member is engaged by the detent member to prevent movement of the housing away from the cap member, and a second armed position, in which the plug member continues to seal the bottom aperture closed and the flange member is deformed to a position in which it can no longer be engaged by the detent member.

The flange member may include one or more plastically deformable portions which deform such that the outside diameter of the flange member in the deformed state when the closure device is in the armed position is less than the outside diameter of the flange member in the undeformed state when the closure device is in the closed position.

Bridge Embodiment

In another preferred embodiment the flange member is adapted to cantilever across all or part of the top of the container neck and is connected to the housing by a plurality of bridge portions of reduced thickness. The detent member is provided on an outer wall of the fluid chamber. In this embodiment the housing is adapted to move relative to the cap member between a first closed position of the closure device, in which the plug member seals the bottom aperture closed and the flange member is engaged by the detent member to prevent movement of the housing away from the cap member, and a second armed position, in which the plug member continues to seal the bottom aperture closed and the bridge portions are fractured so that the flange member is separated from the housing and so that the housing can no longer be engaged by the detent member.

Detachable Detent Embodiment

The housing may comprise an internal rib adapted to engage with the detent member provided on the cap member or fluid chamber. In the first closed position of the closure device the internal rib may be engaged by the detent member to prevent movement of the housing away from the cap member. In the second armed position of the closure device the detent member may be deformed to a position in which the internal rib can no longer be engaged by the detent member.

The housing may include an abutment member adapted to abut against the detent member. The detent member may be detachable by tearing. The detent member may be detachable by movement of the closure device from the first closed position to the second armed position, such as to cause the abutment member on the housing to tear the detent member from the cap member or fluid chamber.

The detent member may be discontinuous and may comprise a plurality of discrete detent portions.

The closure device may comprise corresponding detents on the housing and the fluid chamber to prevent the fluid chamber being removed completely from the housing.

All Embodiments

Preferably the fluid chamber is pressurised.

Preferably the fluid chamber contains a pressurised additive liquid and a propellant fluid.

The flange member can be deformed by securing the closure device to a container neck, such that the top of the container neck is urged against the flange member.

In the first position the closure device can be transported for subsequent fitting to a container. The detent and flange serve to prevent the housing and plug member from moving under the internal pressure of the fluid chamber, thereby maintaining the fluid camber in a sealed, closed state.

When the closure device is fitted to a container, the container neck is urged against the flange member to deform the flange member, so that the closure device is in the second armed position. The flange member itself may be held between the top of the container neck and the cap member, so the housing and plug member continue to be prevented from moving under the internal pressure of the fluid chamber, thereby maintaining the fluid camber in a sealed, closed state. Alternatively, or in addition, friction between the housing and the container neck may the housing and plug member from moving relative to the fluid chamber under the internal pressure of the fluid chamber, thereby maintaining the fluid camber in a sealed, closed state.

Preferably the housing is adapted to move relative to the cap member to a third firing position in which the plug member is arranged to provide a fluid communication path from the fluid chamber through the nozzle of the plug member and in which the flange member is not engaged by the detent member.

This allows an additive liquid in the fluid chamber to be ejected through the nozzle under pressure.

Preferably the fluid chamber is pressurised. The additive liquid is then urged through the nozzle under pressure into the container where it is mixed with the liquid or beverage in the container as a result of being ejected through the nozzle under pressure.

In a first arrangement of the plug member, the nozzle may be provided at the lower end of the plug member, opposite the fluid chamber. The plug member may include an internal nozzle passage extending axially upwards in the plug member from the nozzle.

The plug member may include a transverse internal passage extending to the lateral exterior surface of the plug member and in communication with the internal nozzle passage.

In the closed and armed positions the transverse internal passage may be closed by the bottom aperture of the fluid chamber. For example an upper seal may be provided between the plug member and the bottom aperture above the transverse internal passage.

In the firing position the upper seal may no longer seal between the plug member and the bottom aperture, such that the fluid chamber is in fluid communication with the transverse internal passage and the nozzle. A lower seal may be provided between the plug member and the bottom aperture below the transverse internal passage.

Alternatively the plug member may include a longitudinal internal passage extending to the upper exterior surface of the plug member and in communication with the internal nozzle passage.

In the closed and armed positions the longitudinal internal passage may be closed by a projecting plug fixed relative to the fluid chamber.

In the firing position the projecting plug may be spaced from the upper exterior surface of the plug member, such that the fluid chamber is in fluid communication with the longitudinal internal passage and the nozzle.

The plug member may include sealing means to provide a seal between the lateral external surface of the plug member and the aperture of the fluid chamber. The sealing means may be a coating of an elastomeric material, such as a soft plastic. The sealing means may form the upper and/or lower seals.

The housing may include an upper cylindrical portion adapted to fit inside a neck of the container. The housing may include a plurality of leg members extending from the upper cylindrical portion to the plug member. The leg members may be spaced from each other to allow fluid flow between the leg members. The leg members may be arranged to at least partially surround the fluid chamber so as to guide the fluid chamber while the fluid chamber moves from the closed position to the armed position and to the firing position.

In a second arrangement of the plug member, the plug member has an annular channel adapted to sealingly engage with the open end of a cylindrical wall portion of the tank, wherein the annular channel has at least one orifice which is arranged to be sealed from the interior volume of the tank when the annular channel is sealingly engaged with the open end of the cylindrical wall portion in the first closed position and second armed position of the closure device and which is in fluid communication with the interior volume of the tank when the annular channel is separated from the open end of the cylindrical wall portion in the third firing position of the closure device.

The open end of the cylindrical wall portion and the annular channel effectively form a plug and socket, which serve to seal the one or more orifices when the closure device is in the closed and armed positions, but open all the one or more orifices simultaneously when the tank is raised relative to the plug member and the closure device is in the firing position.

The annular channel may have a plurality of orifices which are arranged to be sealed from the interior volume of the tank when the annular channel is sealingly engaged with the open end of the cylindrical wall portion in the closed and armed positions of the closure device and which are in fluid communication with the interior volume of the tank when the annular channel is separated from the open end of the cylindrical wall portion in the firing position of the closure device. Preferably the orifices are arranged in an annular pattern.

If the closure assembly has a plurality of orifices, an additive liquid can be ejected in a "shower head" pattern, to improve distribution and mixing of the additive liquid within the beverage or other liquid in the container.

Preferably the plug member includes a stopper portion adapted to project inside the open end of the cylindrical wall portion of the tank in the closed and armed positions. Such a stopper portion comprises a secure and positive seal to the pressurised tank.

The plug member may include a seal in the annular channel adapted to seal between the plug member and an internal surface of the cylindrical wall portion in the closed and armed positions. Such a seal ensures that the tank cannot leak during storage of the closure device in its pressurised state, either before or after fitting to a container.

The plug member may include a seal in the annular channel adapted to seal between the plug member and an external surface of the cylindrical wall portion in the firing position. Such a seal ensures when the additive is fired under pressure from the tank it cannot pass upwards outside the tank between the neck of the container and the tank.

The fluid chamber may be a single moulded article. The fluid chamber may be moulded from PET or other suitable plastic material.

Preferably the cap wall is provided with internal threads adapted to engage with external threads on the neck of the container.

The fluid chamber may contain an additive liquid and a pressurised propellant gas.

The housing and the fluid chamber may be provided with mutually engaging detent means to prevent the separation of the cap member and the housing. This ensures that the housing is removed with the rest of the closure device when the cap member is unscrewed from the container neck.

The mutually engaging detent means may be provided on the exterior surface of the side wall of the fluid chamber and the internal surface of a cylindrical wall of the housing, for example in the form of circumferential ribs.

Alternatively the mutually engaging detent means may be provided on the exterior surface of a side wall of the bottom aperture of the fluid chamber and the internal surface of a corresponding cylindrical wall of the housing surrounding the side wall of the bottom aperture, for example in the form of circumferential ribs.

Container and Closure

According to a second aspect of the present invention there is provided a container having a container neck and an opening, wherein the container contains a liquid, and wherein a closure device according to the first aspect of the present invention is secured to the container neck to close the container.

Preferably the flange member is held between the top of the container neck and the cap member. Preferably the closure member is in the armed position.

Method of Firing

According to a third aspect of the present invention there is provided a method of introducing an additive liquid into a container, the method comprising:

- providing a closure device according to the first aspect of the invention,
- introducing into the fluid chamber a liquid additive and a pressurised propellant,
- while the closure device is in the first closed position placing the closure device on the neck of a container containing a liquid,
- lowering the closure device onto the neck of the container such that the neck of the container contacts the flange member of the housing,
- further lowering the cap member relative to the housing such that the flange member of the housing or detent member is deformed to a position in which the flange member or housing or cap member can no longer be engaged by the detent member and the closure device is in the second armed position, and
- raising the closure device on the neck of the container such that the cap member and fluid chamber are raised relative to the plug member and the closure device is in a third firing position in which a fluid communication path is provided from the fluid chamber through the nozzle of the plug member.

During the step of lowering the cap member relative to the housing, the neck of the container may deform the flange member of the housing to a position in which the flange member or housing can no longer be engaged by the detent member.

Preferably the method includes the step of urging the additive liquid from the fluid chamber into the container under pressure of the pressurised propellant in the fluid chamber while the closure device is in the third firing position.

Preferably the method includes the step of mixing the additive liquid with the liquid in the container.

The liquid in the container may be a beverage or a chemical or pharmaceutical composition. The liquid may be of any viscosity, for example a gel.

The mixing step may be effected through ejection of the additive liquid through the nozzle at a sufficient velocity under pressure of the pressurised propellant in the fluid chamber.

Collapsible Flange Embodiment

In one preferred embodiment, before the deformation step the flange member extends across the top of the container neck and engages with a detent member provided on an inner surface of the threaded side wall of the cap member.

Preferably in the deformation step the flange member is deformed to a position in which it can no longer be engaged by the detent member.

Preferably in the deformation step one or more plastically deformable portions of the flange member are deformed such that the outside diameter of the flange member in after deformation is less than the outside diameter of the flange member before deformation.

Bridge Embodiment

In another preferred embodiment, before the deformation step the flange member extends in a cantilevered manner across all or part of the top of the container neck and is connected to the housing by a plurality of bridge portions of reduced thickness.

Preferably before the deformation step a portion of the flange member engages with a detent member provided on an outer wall of the fluid chamber.

Preferably in the deformation step the flange member is deformed by fracturing one or more bridge portions so that the flange member is separated from the housing, and so that the housing can no longer be engaged by the detent member.

In the deformation step the housing may be retained by the detent portion from moving with the flange member.

Detachable Detent Embodiment

In another preferred embodiment the detent member is provided on the cap member or fluid chamber, and during the further lowering of the cap member relative to the housing, the detent member is detached by tearing such that the housing can no longer be engaged by the detent member.

The housing may comprise an internal rib adapted to engage with the detent member provided on the cap member or fluid chamber. During the further lowering of the cap member relative to the housing, the detent member may be deformed to a position in which the internal rib can no longer be engaged by the detent member.

The housing may include an abutment member adapted to abut against the detent member. During the further lowering of the cap member relative to the housing, the detent member may be detached by movement of the cap member relative to the housing, such as to cause the abutment member on the housing to tear the detent member from the cap member or fluid chamber.

During the step of raising the closure device on the neck of the container such that the cap member and fluid chamber are raised relative to the plug member, corresponding detents provided on the housing and the fluid chamber may engage with each other to prevent the fluid chamber being removed completely from the housing.

BRIEF DESCRIPTION OF THE DRAWINGS

The invention will be described, by way of example only, with reference to the drawings in which.

DESCRIPTION OF SPECIFIC EMBODIMENTS

Collapsible Flange Embodiment

Figure 1:
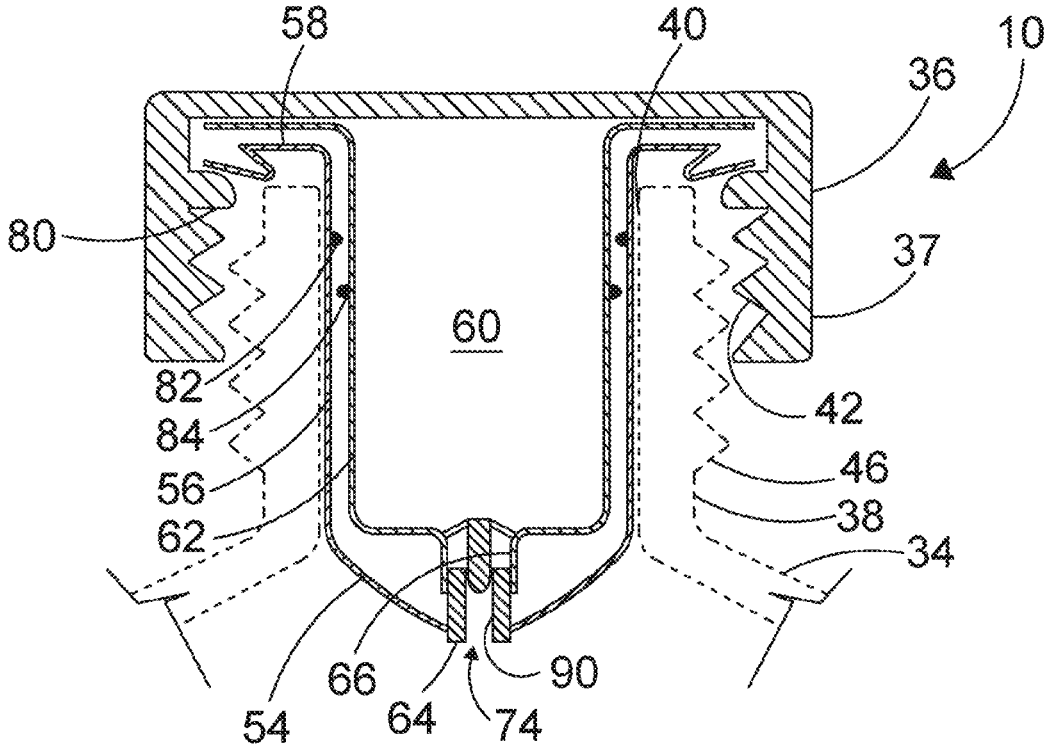
FIG. 1 shows a schematic cross-sectional view of a closure device according to an embodiment of the present invention.

With reference to FIG. 1 there is shown a closure device 10 in a first closed position. The closure device 10 is depicted connected to the upper part of a container 34 that contains a fluid (not shown). The container depicted has a neck 38. The container 34 may be, for example, a PET bottle. The container 34 may hold a variety of liquids such as water, or a pharmaceutical or glucose solution. The liquid may be for consumption, but may instead be a chemical composition for other use, such as cleaning, healthcare, hair dye application, painting or household maintenance. However, for the purposes of this description, the liquid held in the container 34 will hereinafter be referred to as the beverage.

The closure device 10 includes a cap member 36. The closure device 10 is used to close an opening 40 in the neck 38 and is attached to the container 34 by the cap member 36. The cap member 36 is detachably attached to the container neck 38 by a threaded arrangement. The threaded arrangement comprises an external thread 46 located on an outer surface of the container neck 38 that engages with an internal thread 42 located on an inner surface of the side wall 37 of the cap member 36. Thus the cap member 36 can be unscrewed and removed by a user of the closure device 10. All of the aforementioned components may be formed of polypropylene, or other suitable material.

Inside the cap member 36 a fluid chamber 60 is located. The fluid chamber 60 contains an additive liquid and a pressured propellant fluid. The fluid held in the fluid chamber 60 may be of significantly greater pressure than the beverage held in the container 34. The fluid chamber 60 is enclosed by a fluid chamber wall 62. The fluid chamber 60 may be formed using plastic injection moulding and may be formed of PET or any other suitable plastic. In the example of FIG. 1 the fluid chamber 60 is formed by bonding the wall 62 to the underside of the cap member 36. However the chamber 60 may be formed as a separate blow moulded chamber as in the embodiment of FIG. 2.

The fluid chamber 60 is surrounded by a housing 54 that sits within the container neck 38. The housing 54 includes a cylindrical housing wall 56 that extends substantially parallel to the container neck 38. At the top of the housing wall 56 is a collapsible flange member 58 which extends over the top of the container neck 38 to engage with a detent 80 formed on the inside of the side wall 37 of the cap member 36.

The flange member 58 in the example of FIG. 1 has a concertina arrangement. It is plastically deformable, and includes a number of radial slots which extend from the housing wall 56 to the perimeter of the flange member 58, so the flange member 58 in plan has the appearance of a number of separate segments.

When an upwards force is applied to the flange member 58, for example by the neck 38 when the cap member 36 is screwed down onto the neck 38, the flange member 58 is deformed so that the overall diameter of the flange member 58 is reduced, and the flange member 58 no longer extends as afar out as the detent 80. Hence the housing 54 is no longer retained within the cap member 36 by the coupling of the flange member 58 and the detent 80.

The housing 54 may further comprise leg members that extend from the cylindrical wall 56 to a plug member 64. Alternatively the housing wall 56 may extend itself to the plug member 64.

Both the housing 54 and the plug member 64 may be formed by injection moulding or another suitable method. Typically the housing 54 fits with a friction fit in the neck 38, so that it may resist a small force, but can be extracted from the neck without requiring a large force.

In the example of FIG. 1 the plug member 64 is a cylindrical member which extends upwards from the base of the housing 54 and is adapted to engage sealingly with an aperture 66 in the fluid chamber 60. The plug member 64 has a central bore 90 which is itself plugged by a spike plug member 92 fixed by a number of radial arms 94 to the top of the aperture 66 in the fluid chamber 60. The bore 90 extends to an outlet nozzle 74 at the lower end of the plug member 64. The plug member 64 has a coating of formed of a resilient, soft plastic or rubber material such as mouldable thermo plastic elastomer or nitrile rubber, which acts to form a seal between the plug member 64 and the aperture 66 in the fluid chamber 60.

Figure 2:
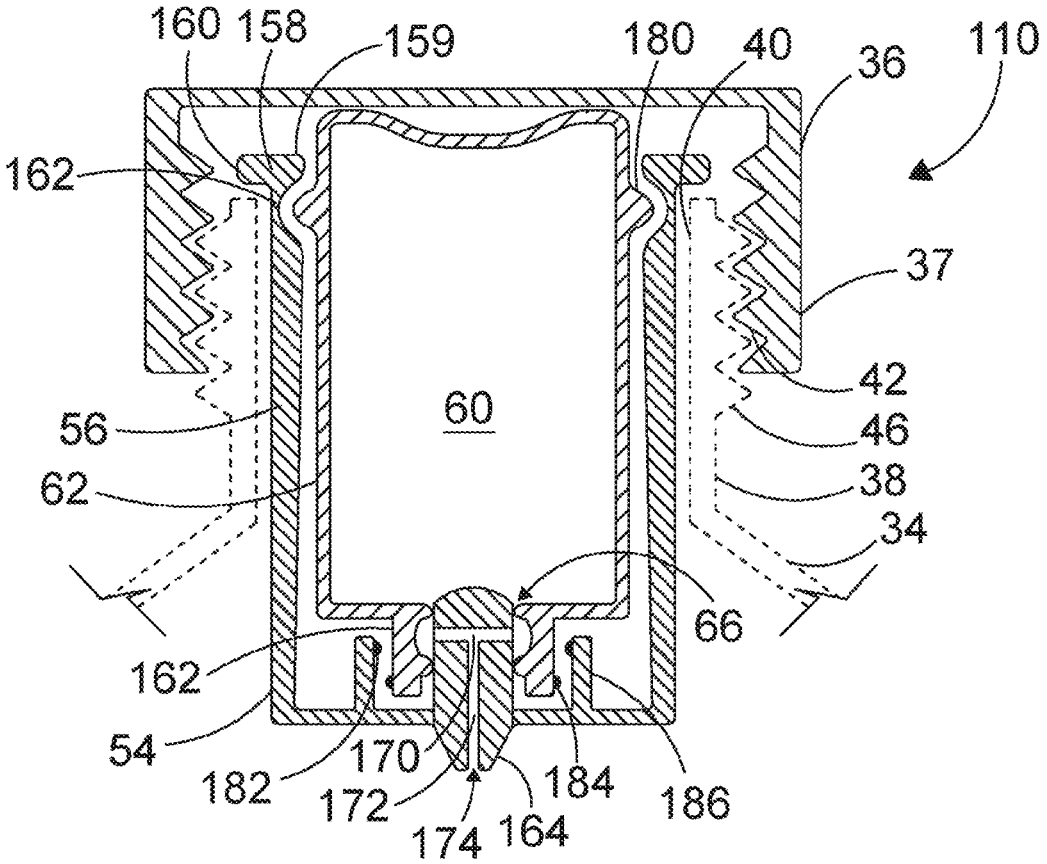
FIG. 2 shows a schematic cross-sectional view of a closure device according to another embodiment of the present invention.

Alternatively the plug member may be similar to that illustrated in FIG. 2. In FIG. 2 the plug member 164 of the housing is a cylindrical member which extends upwards from the base of the housing 54 and is adapted to engage sealingly with an aperture 66 in the fluid chamber 60.

The plug member 164 includes a lateral passage 170 that extends between the outer walls of the plug member 164.

The plug member 164 further includes a longitudinal internal nozzle passage 172 that extends downwards from the lateral passage 170 to a nozzle 174. The plug member 164 has a coating of formed of a resilient, soft plastic or rubber material such as mouldable thermo plastic elastomer or nitrile rubber, which acts to form a seal between the plug member 164 and the aperture 66 in the fluid chamber 60. Alternatively, separate O-ring seals could be utilised to form the seals between the plug member 164 and the aperture 66.

The closure device 10 may include anti-tamper means (not shown) to prevent rotation of the cap member 36 relative to the container neck 38 and vertical lifting of the cap member 36.

With reference to FIG. 1, the operation of the closure device is as follows. The closure device 10 can be assembled in a separate process and at a separate location from the filling process by which the container 34 is filled with a beverage. A liquid additive and a pressurised propellant are introduced into the fluid chamber 60 and the closure device is assembled to adopt the closed position illustrated in FIG. 1, for example by filing and assembling in a pressurised environment. In this position the internal pressure of the fluid chamber urges the plug member 64 out of the aperture 66, and so urges the housing 54 downwards relative to the fluid chamber 60 and cap member 36. However the engagement of the flange member 58 with the detent 80 prevents the separation of the housing 54 and cap member 36, and maintains the plug member 64 in the aperture 66.

The closure device 10 may be transported to the container filling station in the closed position. After the container 34 has been filled with a beverage, the closure device 10 is placed on the neck 38 of the container, still in the closed position. The closure device 10 is then lowered onto the neck of the container by screwing action until the top of the neck 38 of the container contacts the flange member 58 of the housing 54. Further lowering of the closure device 10, by further screwing action, onto the neck 38 of the container results in the neck 38 deforming the flange member 58 to a position in which the flange member 38 can no longer be engaged by the detent member 80. The closure device 10 is screwed down as far as it can go, so the neck 38 presses the deformed flange member 58 against the underside of the cap member 36, while the plug member 64 penetrates further into the aperture 66 in the fluid chamber 60, and the closure device 10 is now in a second armed position. In the armed position the closure device 10 is ready to fire the additive through the nozzle 74, but has not yet done so.

The container 34 and the closure device 10 remain in the armed position while the container 34 is transported to its point of sale or use.

When the container 34 is ready to be used, a user raises the closure device 10 on the neck 38 of the container, by unscrewing the cap member 26, such that the cap member 36 and fluid chamber 60 are raised relative to the plug member 64, and the closure device 10 is then in a third firing position in which a fluid communication path is provided from the fluid chamber 60 through the nozzle 74 of the plug member 64. This firing position is similar to that described in detail in WO2007/129116, and is not described further here. In the firing position the plug member 64 is at least partially removed from the aperture 66, and the additive liquid is urged from the fluid chamber 60 through the bore 90 and out of the nozzle 74 into the container 34 under pressure of the pressurised propellant in the fluid chamber 60. The closure device 10 is now in the third firing position.

In practice one turn or less of the cap member 36 is required to move the closure device 10 from the armed position to the firing position. Further rotation of the cap member 36 allows the cap member 36 and the housing 54 to be removed from the neck of the container. In the embodiment of FIG. 1 corresponding detents 82, 84 on the inner surface of the wall 56 of the housing 54 and the outer surface of the wall 62 of the fluid chamber 60 prevent the fluid chamber 60 being removed completely from the housing 54. Hence as the cap member 38 is unscrewed, the low friction force holding the housing 54 in the neck 38 is overcome, and the closure device 10 is removed in its entirety.

Figure 5B:
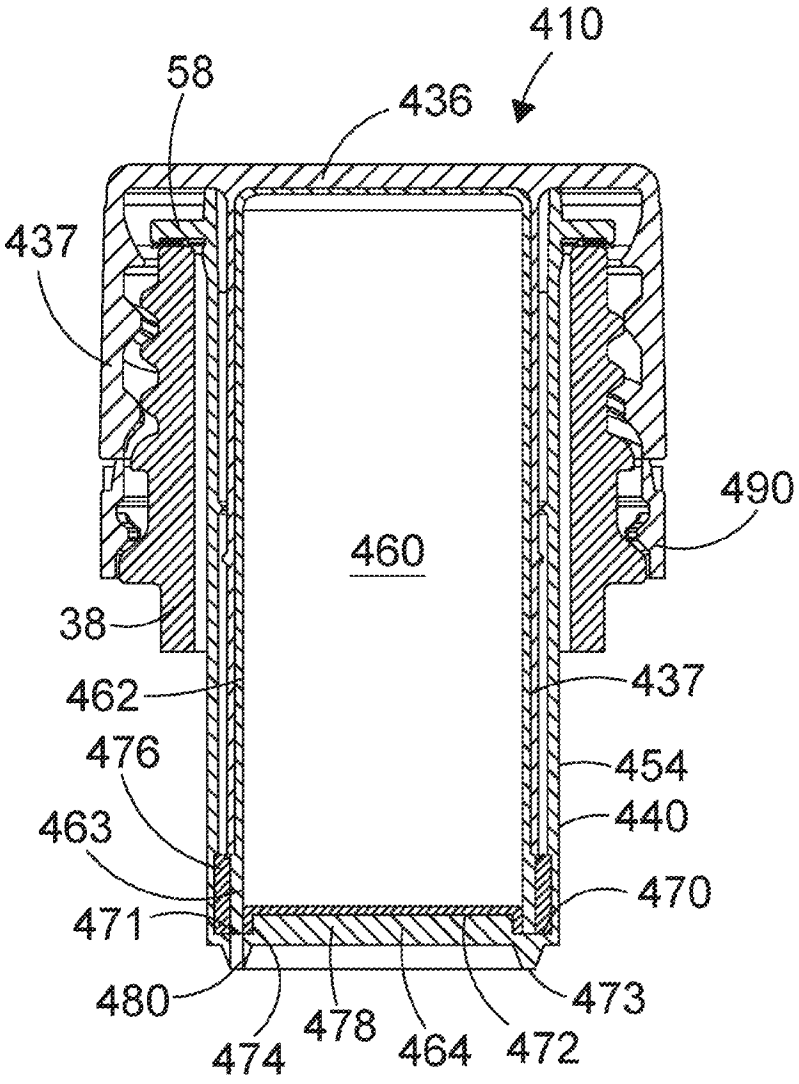
FIGS. 5A, 5B and 5C show schematic cross-sectional views of a closure device according to another embodiment of the present invention.
Figure 5A:
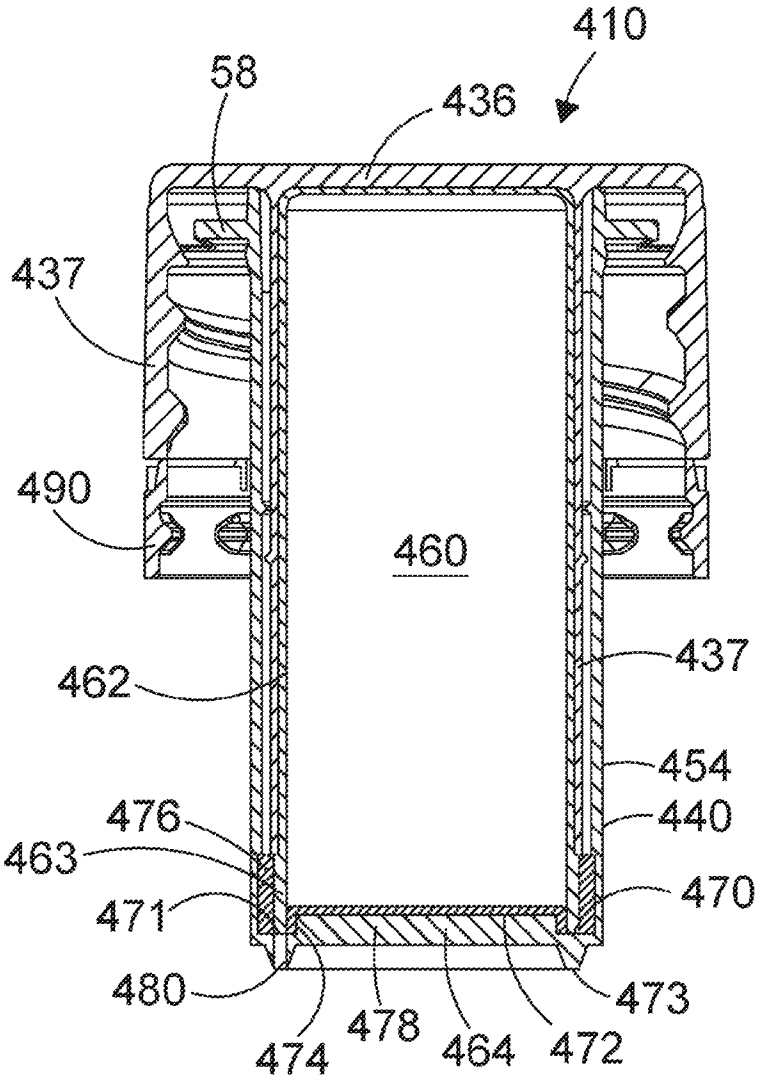
Figure 5C:
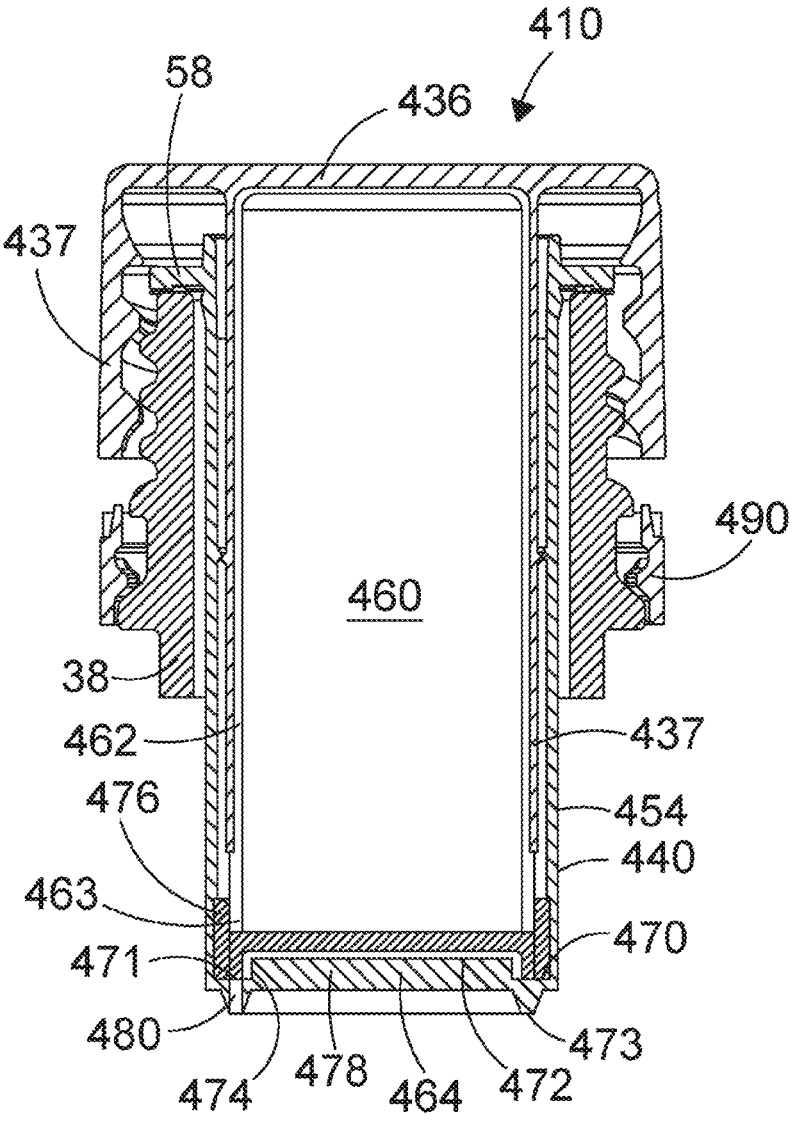

The embodiment of FIGS. 5A, 5B and 5C is similar to the embodiment of FIG. 1, but has a different plug member 464. Components which are similar to those illustrated in the embodiment of FIG. 1 have the same reference number. The closure device 410 is shown in the closed, armed and firing positions in FIGS. 5A, 5B and 5C respectively.

The closure device 410 is adapted to be fitted to the neck 38 of a container that contains a fluid (not shown), for example, a PET bottle.

The closure device 410 includes a cap member 436 with a threaded side wall 437. A fluid chamber or tank 460 is connected to the cap member 436. In the example the cap member 436 includes a cylindrical wall 437 which surrounds the tank 460, which may be formed separately. The cap member 436 is bonded or moulded to the tank 460.

A separate housing 454 sits inside the neck 38 of the bottle. The casing includes a sleeve portion 440 which surrounds the tank 460 and has a plug member 464 at its lower end. At its upper end the housing 454 includes a collapsible flange 58 as described with reference to FIG. 1.

The fluid chamber 460 contains an additive liquid and a pressured propellant fluid. The fluid held in the fluid chamber 460 may be of significantly greater pressure than the beverage held in the container. The fluid chamber 460 is enclosed by a fluid chamber wall 462. The fluid chamber 460 may be formed using plastic injection moulding and may be formed of PET or any other suitable plastic. In the example of FIG. 5A the fluid chamber 460 is formed as a separate blow moulded chamber and secured to the closure 436 by moulding the cap member 436 around it. However the fluid chamber 460 may be simply bonded to the cap member 436 by adhesive or formed by any other means.

The housing 454 and the plug member 464 may be formed by injection moulding or another suitable method.

In the closed or storage position of FIG. 5A and the armed position of FIG. 5B the fluid chamber 460 is sealed closed by a valve arrangement comprising an annular boss member 463 and the plug member 464. The annular boss member 463 is formed from an open end of the cylindrical wall 462 of the tank 460. In the example the annular boss member 463 has a wall thickness greater than the remainder of the tank wall 462. The plug member 464 has an annular channel 470 arranged in the first upper side 472 of the plug member 464. The channel 470 has inner and outer concentric side walls and a channel floor 471.

The channel 470 has a first seal 474 provided on the inner concentric side wall of the channel 470 which seals between the plug member 464 and an internal surface of the annular boss member 463 in the closed and armed positions of FIGS. 5A and 5B. The internal surface of the annular boss member 463 is an internal surface of the wall 462 of the tank 460.

The channel 470 also has a second seal 476 provided on the outer concentric side wall of the channel 470 which seals between the plug member 464 and an external surface of the annular boss member 463 in the closed and armed positions of FIGS. 5A and 5B. The external surface of the annular boss member 463 is an external surface of the wall 462 of the tank 460.

The annular channel 470 has one or more orifices 480 extending from the channel floor 471 through the plug member 464 to a second lower side 473 of the plug member 464 opposite the first upper side 472.

The plug member 464 includes a stopper portion 478 which in the closed position projects inside the boss member 463, and acts with the first and second seals 474, 476 to form a secure and positive seal, capable of maintaining the pressure within the pressurised tank 460. The seals 474, 476 ensure that when the closure device 410 is in the closed and armed positions shown in FIGS. 5A and 5B the one or more orifices 480 are sealed closed and are not in communication with the interior volume of the tank 460.

The cap member 436 optionally includes a detachable or frangible portion 490, referred to as a tamper-evident band, of the type which is known in the art. The frangible portion 490 prevents the cap member 436 from being unscrewed from the neck 38 of the bottle until the frangible portion 490 has been removed.

FIG. 5C shows the closure device 410 in the open or firing position. The frangible portion 490 has been separated from the cap member 436, and the cap member 436 and tank 460 have been raised relative to the housing 454 and plug member 464, so that the plug member 464 is no longer fully engaged with the open end of the tank 460. The stopper portion 478 is below the annular boss member 463, which no longer is engaged in the annular channel 470. The one or more orifices 480 are now in communication with the interior volume of the tank 460, so that the liquid additive is fired through the orifices under the action of the pressurised propellant in the tank 460.

A further detent or stop mechanism (not shown) may be provided to prevent further rotation of the cap member 436 relative to the housing 454, so that further rotation of the cap member 436 causes both the cap member 436 and housing 454 to be lifted on the threads of the neck 38 so that the closure device 410 can be removed from the neck 38 of the bottle.

Bridge Embodiment

The embodiment of FIG. 2 operates in a similar way, as the closure device 110 moves between the three positions, closed, armed and firing. Like components have the same reference numerals as in the embodiment of FIG. 1. In the closure device 110 of FIG. 2 the flange member 158 has a cantilever flange 160, which extends in a cantilevered manner across all or part of the top of the container neck. The flange member 158 is connected to the housing wall by a plurality of bridge portions 162 of reduced thickness. The flange member 158 includes an abutment portion 159 which engages with a detent member 180 provided on the outer wall 62 of the fluid chamber 66.

During the deformation step, when the cap member 36 is screwed down tightly onto the neck 38, the flange member 158 is deformed by fracturing one or more bridge portions 162 so that the flange member 158 is separated from the housing wall 56 and the housing 54. As a result the housing can no longer be engaged by the detent member 180. The flange member 158 is pushed upwards relative to the detent member 180, while the protruding part of the housing wall 56 just below the detent member 180, formed by the "necking" of the wall 56 to form the bridge portions 162, is restrained by the detent member 108 so that the bridge portions 162 are stretched until they break. In practice the bridge portions may be arranged around the perimeter of the housing wall 56, with circumferential spaces in between. The bridge portions may be of the form of bridge portions known in tamper-proof bands.

In the embodiment of FIG. 2 corresponding detents 182, 184 on the inner surface of an upstand wall 186 on the housing 54 and the outer surface of the aperture wall 162 of the fluid chamber 60 prevent the fluid chamber 60 being removed completely from the housing 54. Hence as the cap member 38 is unscrewed, the low friction force holding the housing 54 in the neck 38 is overcome, and the closure device 10 is removed in its entirety.

Although illustrated with a plastic screw cap, the closure device of FIGS. 1 and 2 can include a crown cap as the cap member.

Detachable Detent Embodiment

Figure 3B:
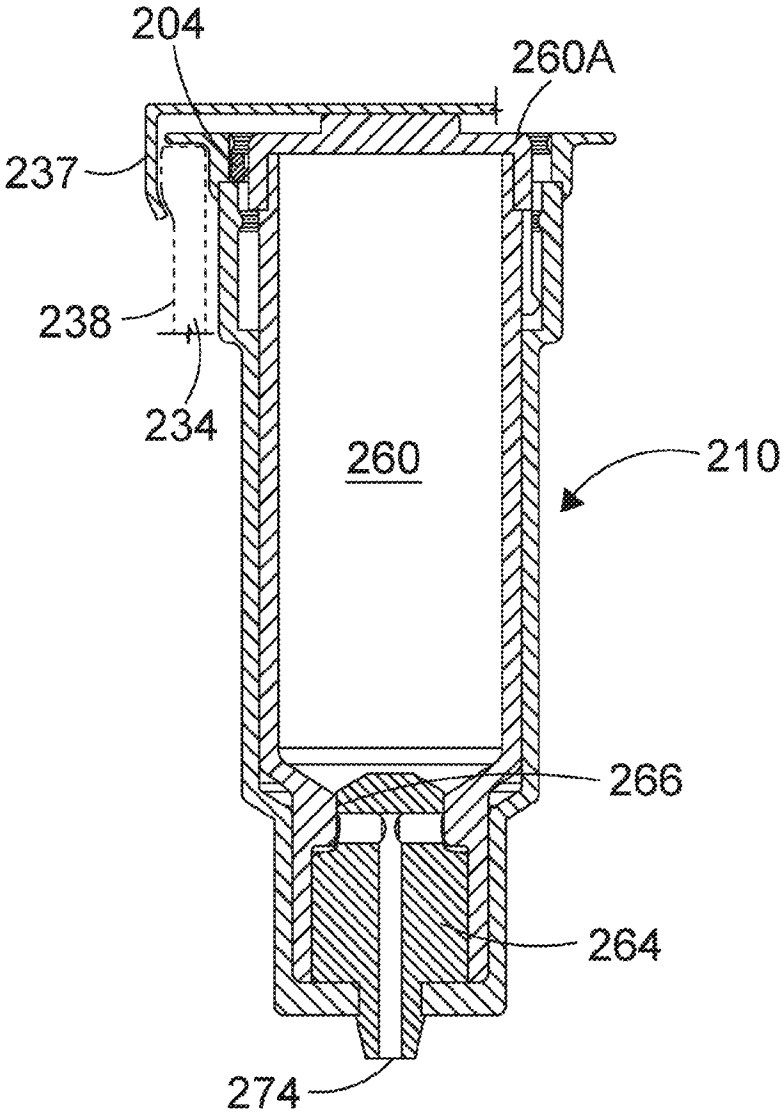
FIGS. 3A, 3B and 3C show schematic cross-sectional views of a closure device according to another embodiment of the present invention.
Figure 3A:
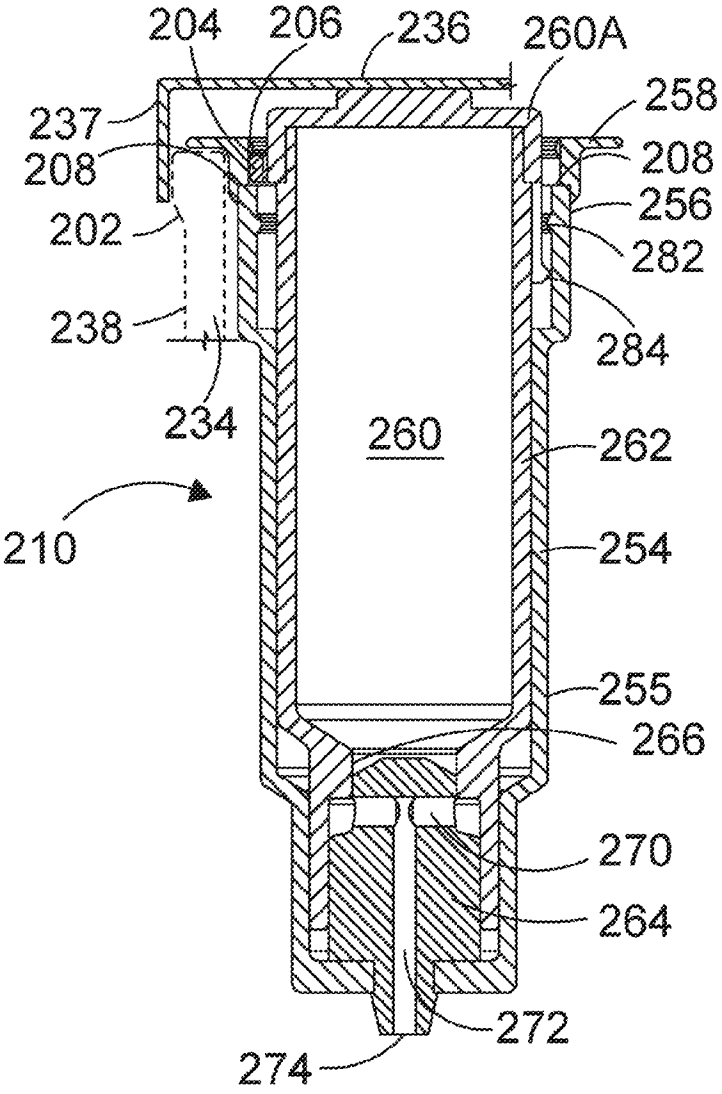
Figure 3C:
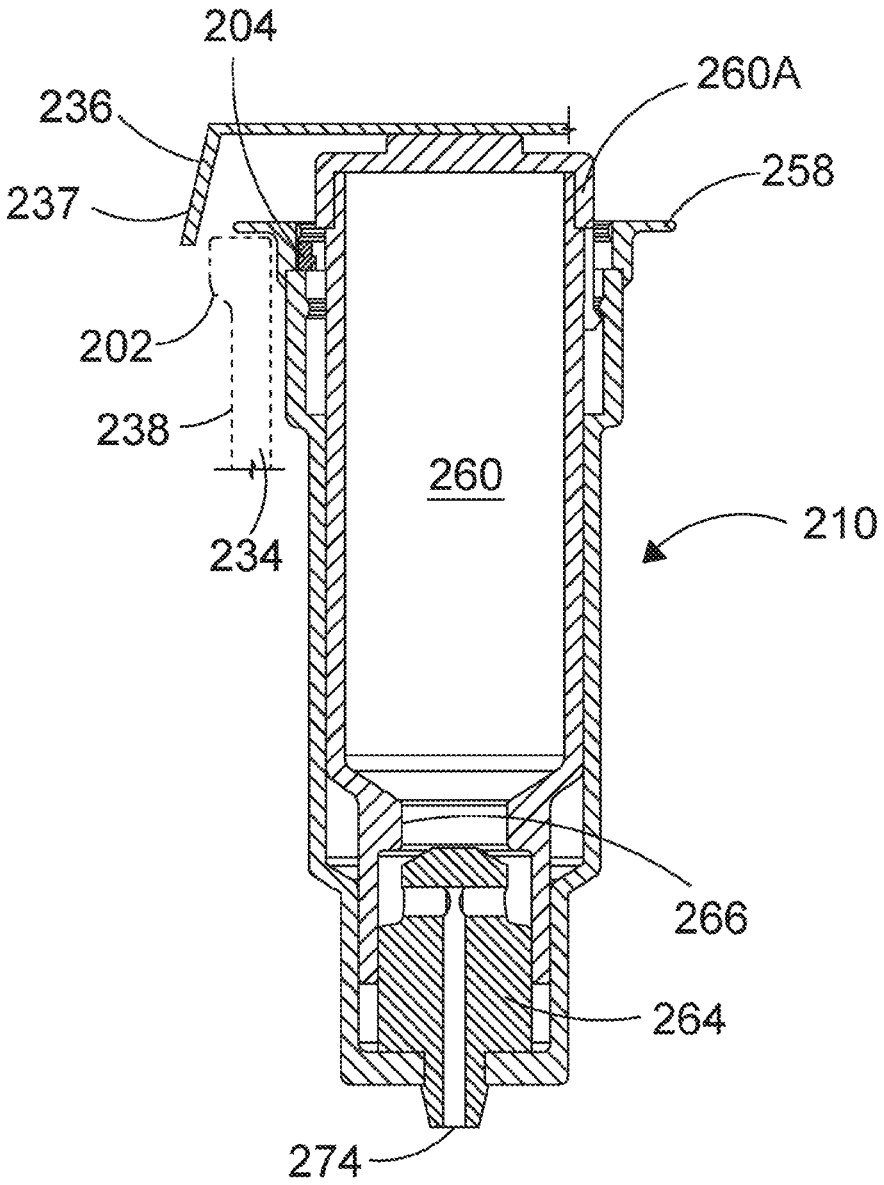

The embodiment of FIGS. 3A, 3B and 3C also operates in a similar way, and FIGS. 3A, 3B and 3C show the closure device 210 in the three positions, closed, armed and firing respectively.

The closure device 210 includes a crown cap 236, which engages with a standard flange 202 provided on the neck 238 of a bottle 234, typically a glass bottle. The flange 202 may be a threaded flange, so that the crown cap 236 can be removed by unscrewing, or the flange 202 can be unthreaded, so that the crown cap 236 is removed in the known way using a conventional bottle opener.

A fluid chamber 260 is attached to the underside of the cap member 236 by bonding. The fluid chamber 260 contains an additive liquid and a pressured propellant fluid. The fluid held in the fluid chamber 260 may be of significantly greater pressure than the beverage held in the container 234. The fluid chamber 260 is enclosed by a fluid chamber wall 262. The fluid chamber 260 may be formed using plastic injection moulding and may be formed of PET or any other suitable plastic. In the example of FIG. 3A the fluid chamber is shown as being formed of two components, including an upper portion 260A which is attached directly to the cap member 236 and welded to the lower portion of the fluid chamber 260. However any form of fluid chamber may be used, such as a single blow moulded fluid chamber 260 which may be bonded directly to the underside of a cap member 236.

The fluid chamber 260 is surrounded by a housing 254 that sits within the container neck 238 in use. The housing 254 includes a cylindrical housing wall 256 that extends substantially parallel to the container neck 238. At the top of the housing wall 256 is a flange member 258 which extends over the top of the container neck 238 when the closure device 210 is inserted in a container 234.

A detachable detent member 204 is provided on the outside surface of the fluid chamber 260, which forms part of the cap member 236. The housing 254 has an internal rib 206 at the top of the cylindrical housing wall 256 which is adapted to engage with the detent member 204 to hold the closure device in the closed position illustrated in FIG. 3A. Wthout the rib 206 the fluid chamber 260 would be free to lift under the action of the internal pressure of the fluid in the fluid chamber against the plug member 264.

The housing 254 includes an abutment member 208, in the form of an internal ledge or step below the flange 258. The abutment member 208 is below the detent member 204 in the closed position of FIG. 3A, and prevents lowering of the fluid chamber 260 relative to the housing 254 without removal of the detent member 204.

Figure 3E:
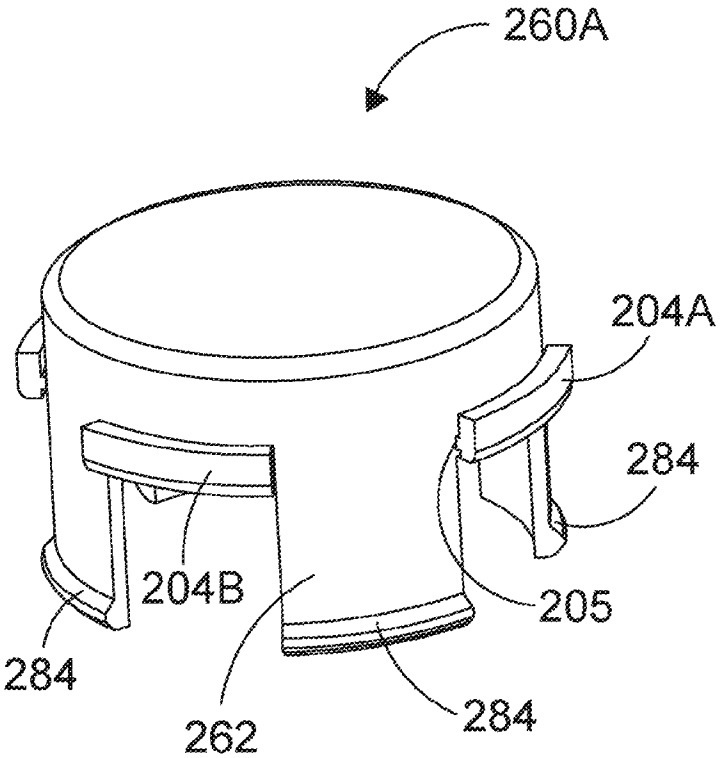
FIGS. 3D and 3E show perspective views of part of the fluid chamber of the closure device of FIGS. 3A, 3B and 3C.
Figure 3D:
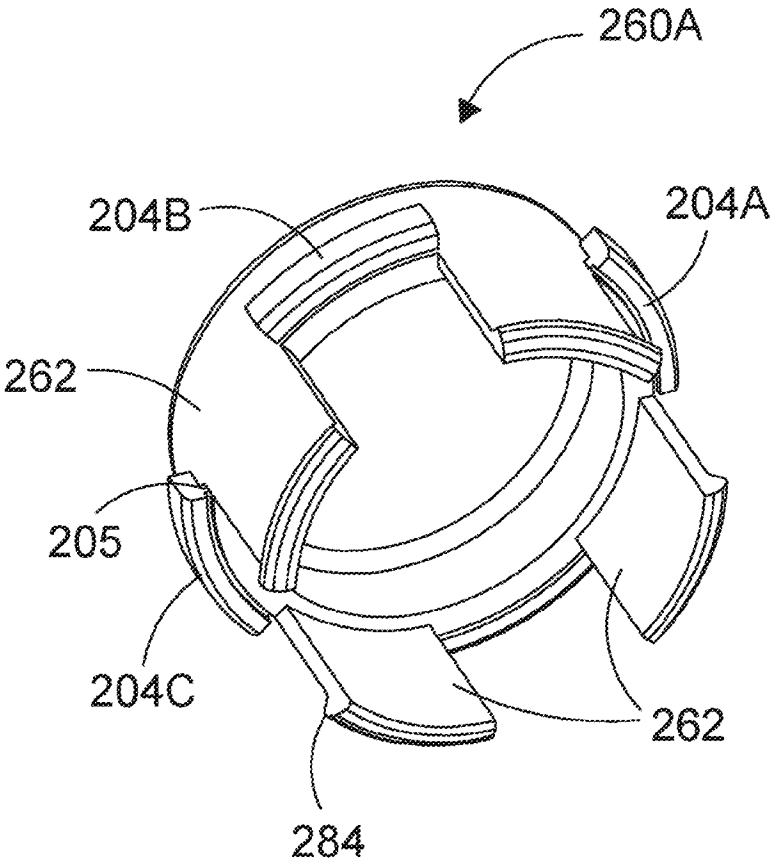

The detent member 204 is shown more clearly in FIGS. 3D and 3E. In the illustrated embodiment the detent member 204 is discontinuous and comprises a plurality of discrete detent portions 204A, 204B, 204C. The detent portion is formed integrally on the upper portion 260A of the fluid chamber 260. The detent member 204 is connected to the fluid chamber wall 262 by narrow bridge portions 205, so that the detent member 204 is detachable from the fluid chamber 260 by tearing.

The upper portion 260A of the fluid chamber 260 also includes a detent 284 which is adapted to engage with a corresponding detent 282 on the housing 254. As can be seen from FIG. 4, the detent 284 may also be discontinuous. The corresponding detents 282, 284 on the housing 254 and the fluid chamber 260 prevent the fluid chamber 260 being removed completely from the housing 254.

The housing 254 may further comprise leg members 255 that extend from the cylindrical wall 256 to the plug member 264. Alternatively the housing wall 256 may extend itself to the plug member 264.

Both the housing 254 and the plug member 264 may be formed by injection moulding or another suitable method. Typically the housing 254 fits with a friction fit in the neck 238, so that it may resist a small force, but can be extracted from the neck without requiring a large force.

In the example of FIG. 3A the plug member 264 of the housing 254 is a cylindrical member which extends upwards from the base of the housing 254 and is adapted to engage sealingly with an aperture 266 in the fluid chamber 260. The plug member 264 includes a lateral passage 270 that extends between the outer walls of the plug member 264. The plug member 264 further includes a longitudinal internal nozzle passage 272 that extends downwards from the lateral passage 270 to a nozzle 274. The plug member 264 has a coating of formed of a resilient, soft plastic or rubber material such as mouldable thermo plastic elastomer or nitrile rubber, which acts to form a seal between the plug member 264 and the aperture 266 in the fluid chamber 260. Alternatively, separate O-ring seals could be utilised to form the seals between the plug member 264 and the aperture 266.

The operation of the closure device 210 is as follows. The closure device 210 can be assembled in a separate process and at a separate location from the filling process by which the bottle 234 is filled with a beverage. A liquid additive and a pressurised propellant are introduced into the fluid chamber 260 and the closure device is assembled to adopt the closed position illustrated in FIG. 3A, for example by filing and assembling in a pressurised environment. In this position the internal pressure of the fluid chamber urges the plug member 264 out of the aperture 266, and so urges the housing 254 downwards relative to the fluid chamber 260 and cap member 236. However the engagement of the internal rib 206 with the detent member 204 prevents the separation of the housing 254 and cap member 236, and maintains the plug member 264 in the aperture 266.

The closure device 210 may be transported to the container filling station in the closed position. After the container 234 has been filled with a beverage, the closure device 210 is placed on the neck 238 of the container, still in the closed position of FIG. 3A. The closure device 210 is then lowered onto the neck 238 of the container until the top of the neck 238 of the container contacts the flange member 258 of the housing 254. Further lowering of the crown cap member 236 onto the neck 238 of the container results in the detent member 204 being deformed and separated from the fluid chamber 260 by tearing of the bridge portions 205 through the shearing action of the abutment 206.

The crown cap member 236 is pushed down as far as it can go, and is engaged with the flange 202 on the bottle neck 238 in the conventional manner, by deformation of the side wall 237. The plug member 264 penetrates further into the aperture 266 in the fluid chamber 260, and the closure device 210 is now in the second armed position, as illustrated in FIG. 3B. In the armed position the closure device 210 is ready to fire the additive through the nozzle 274, but has not yet done so.

The container 234 and the closure device 210 remain in the armed position while the container 234 is transported to its point of sale or use.

When the container 234 is ready to be used, a user raises the closure device 210 on the neck 238 of the container 234, by either unscrewing the cap member 236 or opening the cap member 236 with a lever action bottle opener, such that the cap member 236 and fluid chamber 260 are raised relative to the plug member 264, and the closure device 210 is then in the third firing position, shown in FIG. 3C, in which a fluid communication path is provided from the fluid chamber 260 through the nozzle 274 of the plug member 264. This firing position is similar to that described in detail in WO2007/

129116, and is not described further here. In the firing position the plug member 264 is at least partially removed from the aperture 266, and the additive liquid is urged from the fluid chamber 260 through the bore 270 and out of the nozzle 274 into the container 234 under pressure of the pressurised propellant in the fluid chamber 260.

The closure device 210 can then be removed from the bottle 234. The corresponding detents 282, 284 on the inner surface of the wall 256 of the housing 254 and the outer surface of the wall 262 of the fluid chamber 260 prevent the fluid chamber 260 being removed completely from the housing 254. Hence the low friction force holding the housing 254 in the neck 238 is overcome, and the closure device 210 is removed in its entirety.

Figure 4B:
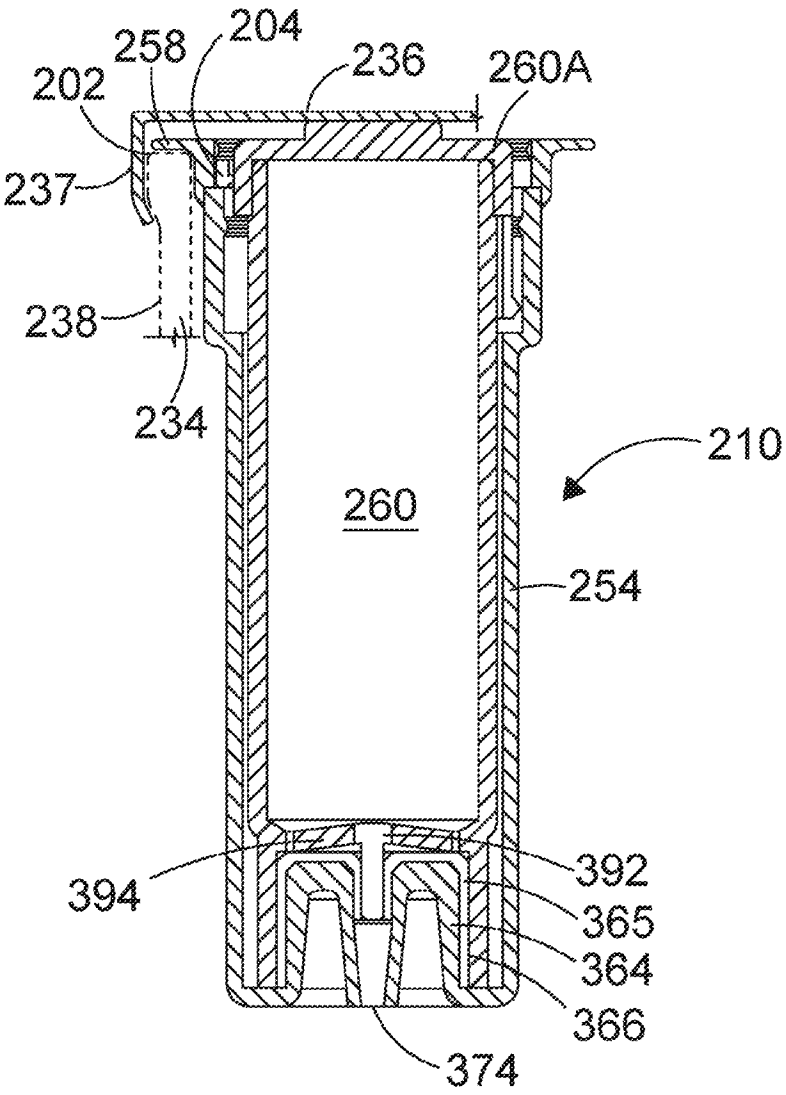
FIGS. 4A, 4B and 4C show schematic cross-sectional views of a closure device according to another embodiment of the present invention.
Figure 4A:
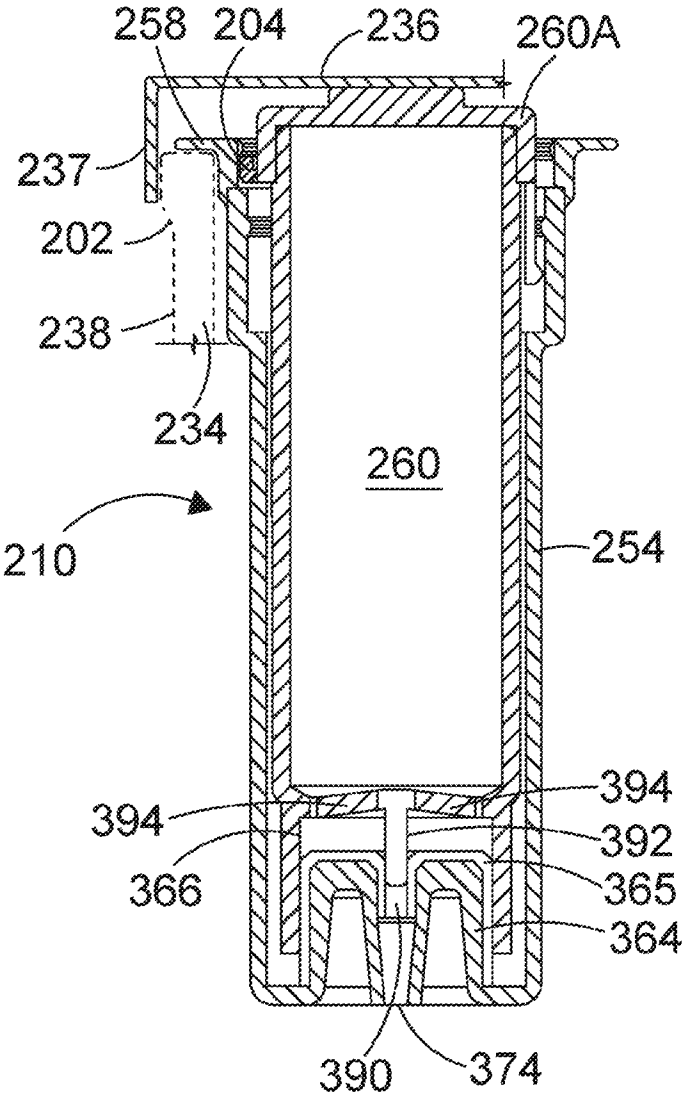
Figure 4C:
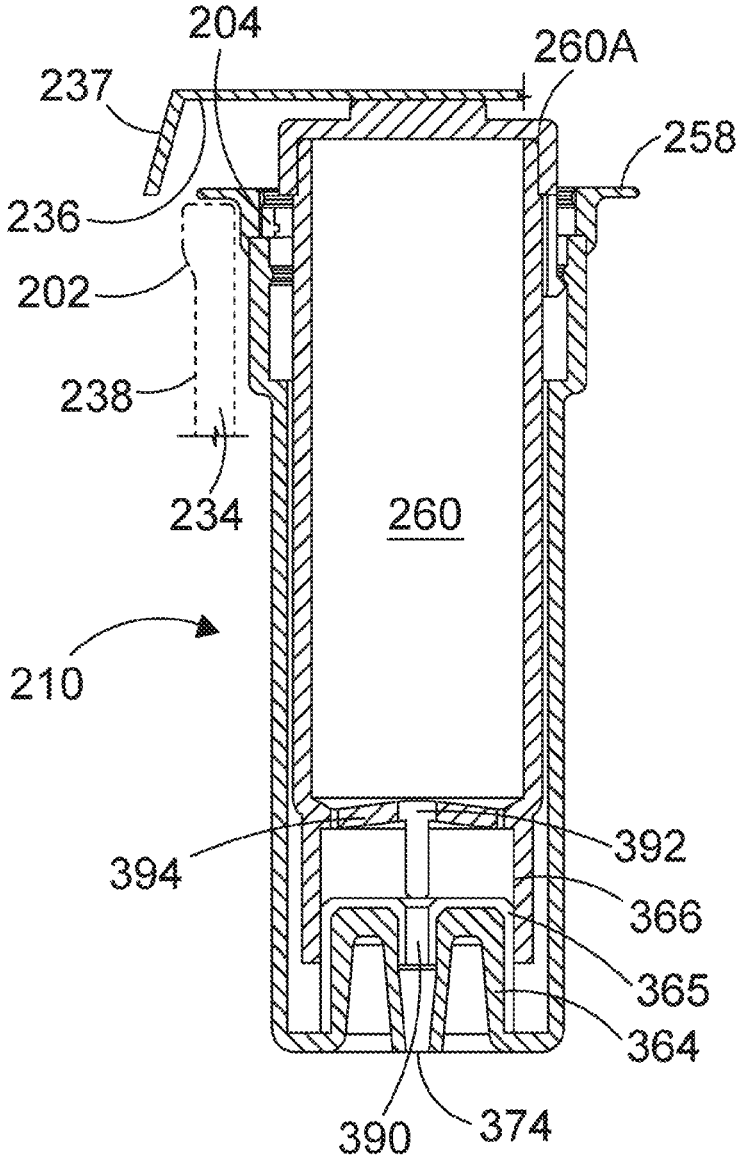

The embodiment of FIGS. 4A, 4B and 4C operates in exactly the same way as the embodiment of FIGS. 3A, 3B and 3C, and the operation is not further described. Like components have the same reference numerals as the embodiment of FIGS. 3A to 3C. The only difference is in the nature of the plug member 364, which in this embodiment is similar to the plug member 64 illustrated in FIG. 1. FIGS. 4A, 4B and 4C show the closure device 210 in the three positions, closed, armed and firing respectively.

The plug member 364 is a cylindrical member which extends upwards from the base of the housing 254 and is adapted to engage sealingly with an aperture 366 in the fluid chamber 260. The plug member 364 has a central bore 390 which is itself plugged by a spike plug member 392 fixed by a number of radial arms 394 to the top of the aperture 366 in the fluid chamber 260. The central bore 390 extends to an outlet nozzle 374 at the lower end of the plug member 364. The plug member 364 has a coating 365 formed of a resilient, soft plastic or rubber material such as mouldable thermo plastic elastomer or nitrile rubber, which acts to form a seal between the plug member 364 and the aperture 366 in the fluid chamber 260, and between the plug member 364 and the spike plug member 392.

Figure 6B:
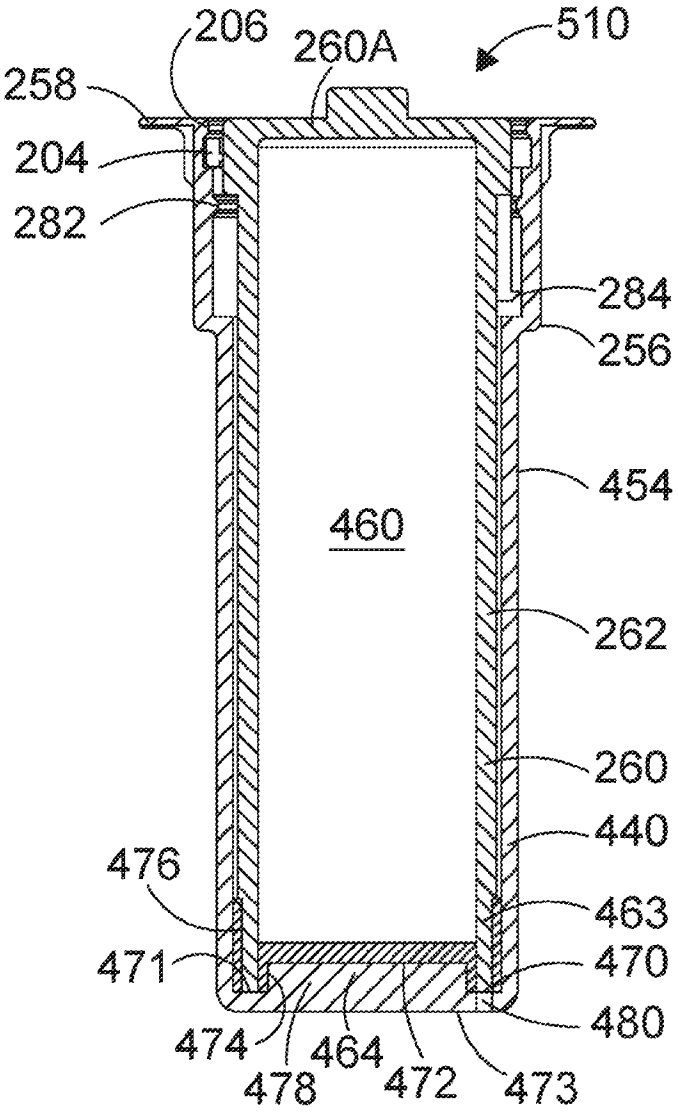
FIGS. 6A, 6B and 6C show schematic cross-sectional views of a closure device according to another embodiment of the present invention.
Figure 6A:
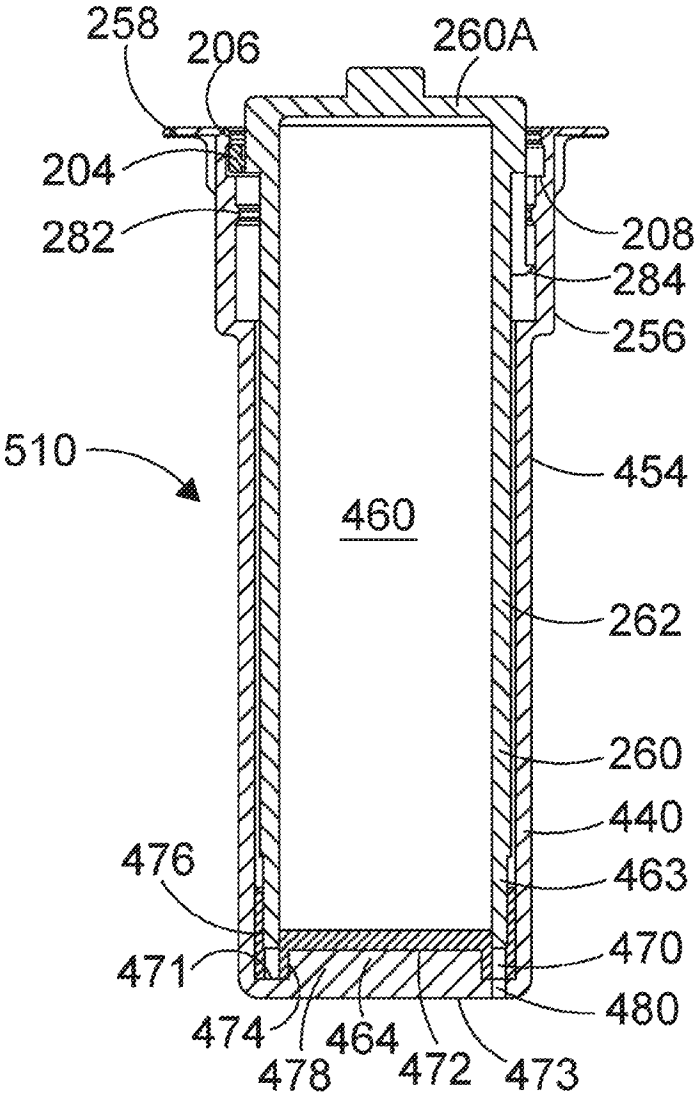
Figure 6C:
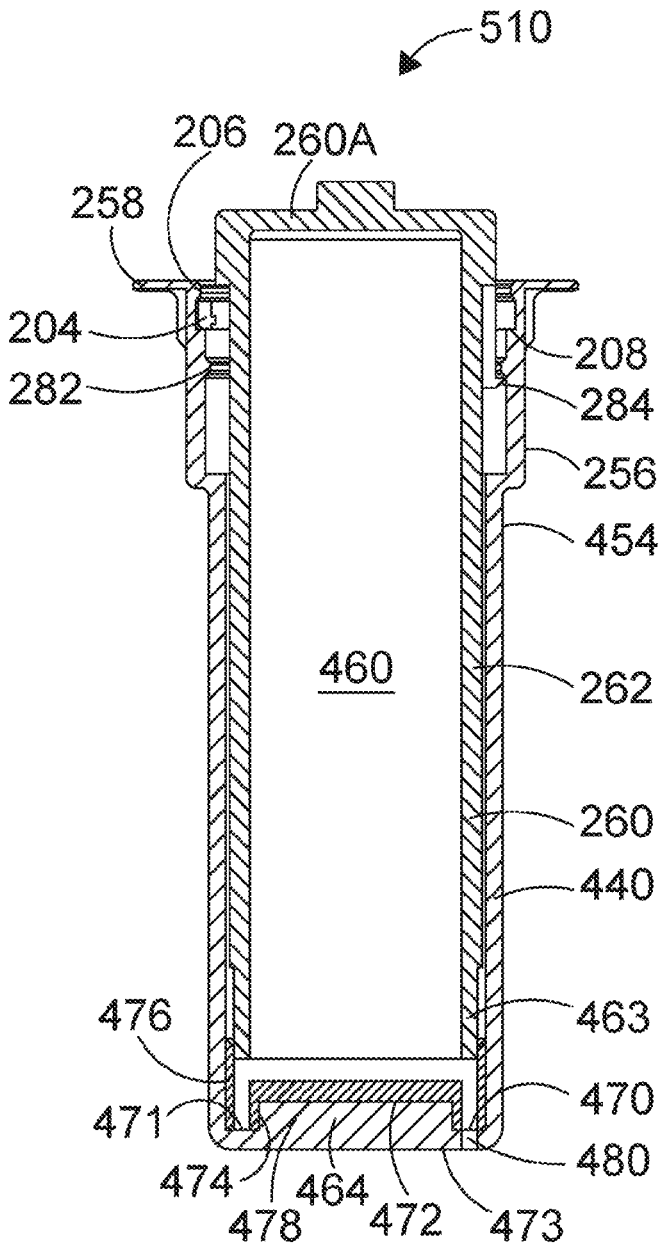

The embodiment of FIGS. 6A, 6B and 6C operates in exactly the same way as the embodiment of FIGS. 3A, 3B and 3C, and the operation is not further described. Again the only difference is in the nature of the plug member 564, which in this embodiment is similar to the plug member 464 illustrated in FIGS. 5A, 5B and 5C. The same reference signs are used to denote components which are the same as those in FIGS. 3A to 3C and 5A to 5C. FIGS. 6A, 6B and 6C show the closure device 510 in the three positions, closed, armed and firing respectively. The flange 202, neck 238, bottle 234 and crown cap 236 are not shown, but are similar to those in FIGS. 3A to 3C.

Because the closure device of the present invention does not require a housing flange between the external thread of the bottle neck and the internal thread of an outer cap wall, the closure device of the present invention is no wider than a conventional closure.

The closure device of the present invention has a maximum of only one threaded connection so the problem with prior art closures, that the two threaded connections may not turn in the correct order, is eliminated.

The closure device of the present invention can operate with no threaded connection, making it suitable for use with crown corks and glass bottles.

The invention is not limited to the specific embodiments described, and modifications and alternatives are possible. The shape, material and size of the various components can be modified. In particular the shape and size of the flange portion can be varied, as can the nature of the deformation of the flange portion.

The invention claimed is:

1. A closure device for use with a container having a main liquid compartment and an opening with a container neck, the closure device comprising:

a cap member having a side wall adapted to be secured to the opening of the container;

a fluid chamber fixed at its upper end to the cap member and having a bottom aperture at its lower end;

a housing at least partially surrounding the fluid chamber and having a flange member adapted to extend at least partially across the top of the container neck;

a plug member fixed to the housing and sealingly engageable in the bottom aperture of the fluid chamber;

wherein the plug member has a nozzle therein; and wherein the housing is adapted to move relative to the cap member between a first closed position of the closure device, in which the plug member seals the bottom aperture closed and the housing or cap member is engaged by a detent member provided to prevent movement of the housing away from the cap member, and a second armed position, in which the plug member continues to seal the bottom aperture closed and the flange member or detent member is deformed to a position in which the housing can no longer be engaged by the detent member.

2. The closure device according to claim 1, wherein the detent member is provided on the cap member or fluid chamber, and in the first closed position of the closure device the housing is engaged by the detent member.

3. The closure device according to claim 2, wherein the housing comprises an internal rib engaged by the detent member to prevent movement of the housing away from the cap member in the first closed position of the closure device, and wherein the detent member is deformable such that in the second armed position of the closure device the detent member is deformed to a position in which the internal rib can no longer be engaged by the detent member.

4. The closure device according to claim 2, wherein the housing includes an abutment member adapted to abut against the detent member, and wherein the detent member is detachable by movement of the closure device from the first closed position to the second armed position, such as to cause the abutment member on the housing to tear the detent member from the cap member or fluid chamber.

5. The closure device according to claim 1, wherein the flange member is adapted to extend across the top of the container neck and engage with the detent member provided on an inner surface of the side wall of the cap member, and wherein the housing is adapted to move relative to the cap member between the first closed position of the closure device, in which the flange member is engaged by the detent member to prevent movement of the housing away from the cap member, and the second armed position, in which the flange member is deformed to a position in which it can no longer be engaged by the detent member.

6. The closure device according to claim 5, wherein the flange member includes one or more plastically deformable portions which deform such that the outside diameter of the flange member in the deformed state when the closure device is in the armed position is less than the outside diameter of the flange member in the undeformed state when the closure device is in the closed position.

7. The closure device according to claim 1, wherein the flange member is adapted to cantilever across all or part of the top of the container neck and is connected to the housing by a plurality of bridge portions of reduced thickness, and wherein the detent member is provided on an outer wall of the fluid chamber.

8. The closure device according to claim 7, wherein the housing is adapted to move relative to the cap member between the first closed position of the closure device, in which the flange member is engaged by the detent member to prevent movement of the housing away from the cap member, and the second armed position, in which the bridge portions are fractured so that the flange member is separated from the housing and so that the housing can no longer be engaged by the detent member.

9. The closure device according to claim 1, wherein the detent member is discontinuous and comprises a plurality of discrete detent portions.

10. The closure device according to claim 1, wherein the fluid chamber contains a pressurised additive liquid and a propellant fluid.

11. The closure device according to claim 1, wherein the housing is adapted to move relative to the cap member to a third firing position in which the plug member is arranged to provide a fluid communication path from the fluid chamber through the nozzle of the plug member and in which the flange member is not engaged by the detent member.

12. The closure device according to claim 1, wherein the nozzle is provided at the lower end of the plug member, opposite the fluid chamber, and the plug member includes an internal nozzle passage extending axially upwards in the plug member from the nozzle.

13. The closure device according to claim 1, wherein the plug member includes sealing means to provide a seal between the lateral external surface of the plug member and the aperture of the fluid chamber.

14. The closure device according to claim 11, wherein the plug member has an annular channel adapted to sealingly engage with the open end of a cylindrical wall portion of the tank, wherein the annular channel has at least one orifice which is arranged to be sealed from the interior volume of the tank when the annular channel is sealingly engaged with the open end of the cylindrical wall in the first closed position and second armed position of the closure device and which is in fluid communication with the interior volume of the tank when the annular channel is separated from the open end of the cylindrical wall portion in the third firing position of the closure device.

15. The closure device according to claim 1, wherein the housing and the fluid chamber are provided with mutually engaging detent means to prevent the separation of the cap member and the housing.

16. A container having a container neck and an opening, wherein the container contains a liquid, and wherein the container further comprises a closure device according to claim 1 secured to the container neck to close the container.

17. The container according to claim 16, wherein the flange member is held between the top of the container neck and the cap member in the armed position.

18. A method of introducing an additive liquid into a container, the method comprising:

providing a closure device according to claim 1, introducing into the fluid chamber a liquid additive and a pressurised propellant;

while the closure device is in the first closed position placing the closure device on the neck of a container containing a liquid;

lowering the closure device onto the neck of the container such that the neck of the container contacts the flange member of the housing;

further lowering the cap member relative to the housing such that the flange member of the housing or detent member is deformed to a position in which the flange member or housing or cap member can no longer be engaged by the detent member and the closure device is in the second armed position; and raising the closure device on the neck of the container such that the cap member and fluid chamber are raised relative to the plug member and the closure device is in a third firing position in which a fluid communication path is provided from the fluid chamber through the nozzle of the plug member.

19. The method according to claim 18, wherein the method includes the step of urging the additive liquid from the fluid chamber into the container under pressure of the pressurised propellant in the fluid chamber while the closure device is in the third firing position.

20. The method according to claim 19, wherein the liquid in the container is a beverage or a chemical or pharmaceutical composition.

* * * * *